US005121512A

United States Patent [19]

Kaufmann

[11] Patent Number: 5,121,512

[45] Date of Patent: Jun. 16, 1992

[54] AUXILIARY INFLATABLE DEVICE SERVING AS MATTRESS

[76] Inventor: Irene Kaufmann, P1 4216, S-460 65 Brålanda, Sweden

[21] Appl. No.: 730,841

[22] PCT Filed: Nov. 1, 1989

[86] PCT No.: PCT/SE89/00005

§ 371 Date: Jul. 15, 1991

§ 102(e) Date: Jul. 15, 1991

[87] PCT Pub. No.: WO90/07317

PCT Pub. Date: Jul. 12, 1990

[30] Foreign Application Priority Data

Jan. 3, 1989 [SE] Sweden ..... 8900022

[51] Int. Cl.[5] ..... A61G 7/057; A47C 27/10

[52] U.S. Cl. ..... 5/453; 5/455; 5/903; 5/469

[58] Field of Search ..... 5/453, 469, 455, 456

[56] References Cited

U.S. PATENT DOCUMENTS

| | | | |
|---|---|---|---|
| 3,775,781 | 12/1973 | Bruno et al. | 5/456 |
| 4,653,130 | 3/1987 | Senoue et al. | 5/469 |
| 4,953,247 | 9/1990 | Hasty | 5/453 |

FOREIGN PATENT DOCUMENTS

| | | | |
|---|---|---|---|
| 159299 | 2/1921 | United Kingdom | 5/455 |
| 1582332 | 1/1981 | United Kingdom | 5/455 |

*Primary Examiner*—Alexander Grosz
*Attorney, Agent, or Firm*—Dvorak and Traub

[57] ABSTRACT

The invention relates to an auxiliary device serving as mattress and consisting of a number of cells (4) fixed to a mattress bottom and extending along the mattress. The cells are individually fillable and evacuable for changing the position of a patient lying on the mattress. The auxiliary device has cloth portions (7; 9) connecting to cells to each other and to the mattress bottom (8) so as to permit substantial lateral movements of the cells relative to the mattress bottom and giving them a certain adaptability with respect to each other.

20 Claims, 10 Drawing Sheets

AUXILIARY INFLATABLE DEVICE SERVING AS MATTRESS

The present invention relates to an auxiliary device serving as mattress, primarily for physically handicapped persons, the active part of the device, i.e. the part which in use forms the surface on which the patient is lying, consisting of a number of individually and freely selectably fillable and evacuable, flexible cell bodies principally extending in the longitudinal direction of the mattress and fixed to a mattress bottom, said cell bodies being adapted, by their upper side, to support the patient and permit varying the position of the patient lying on the mattress by changing the state of expansion of adjacent cell bodies.

An auxiliary device of this type is described in Applicant's Swedish Patent Specification No. 7704380-0 (409,653).

The primary object of the invention is to provide a device of the type stated above which provides an extremely high lateral mobility of the inflatable and deflatable cells which, additionally, are highly self-adaptable to each other when the patient lying on the mattress initiates a change of the filling degree of the different cells in order to bring about a change of his resting position This device should be especially useful for persons having a considerable physical handicap so as to enable them to themselves change their resting position without the assistance of other people.

According to the invention, this object is achieved by means of an auxiliary device which is essentially characterised in that the cell bodies are laterally connected to each other by means of flexible cloth material bridging the gap between the cell bodies, and further connected to said mattress bottom by means of likewise flexible cloth material, whereby the cell bodies are laterally movable in relation to their place of fixation in the mattress bottom and a maximum distance between juxtaposed cell bodies is ensured as well as a certain mutual adaptability of adjacent cell bodies during lateral movement.

Preferably, the cloth connecting the cell bodies to the mattress bottom is fixed to the underside of the cell bodies adjacent the center thereof. In this manner, the cell bodies can be given maximum height in relation to their width and maximum lateral mobility in relation to the mattress bottom.

Suitably, the mattress may have an uneven number, preferably three juxtaposed cell bodies, at least the central cell of the device having at least two pieces of cloth spaced apart from each other in the transverse direction of the cell and connecting it to the mattress bottom. This provides for increased stability against lateral movement of the central cell body, which means that irrespective of the degree of expansion of the other cell bodies, it will be maintained relatively firmly in its central position while being capable of tilting towards the adjacent cell which is least expanded.

Between the outer sides of the cells, the cloth interconnecting the cells and the mattress bottom, there are formed air-receiving spaces, the cloth connecting the cells to each other suitably being air-permeable to permit passage of air to and from parts of the body of the patient lying on the mattress. This provides for efficient ventilation of these body parts, as well as cooling and/or drying thereof.

Suitably, the air cells are surrounded by cloth material passing into the portions connecting the cells to each other and to the mattress bottom. The mattress bottom to which the cells are fixed is suitably formed of cloth material foldable about a mattress-like support structure.

Further, the separate cells suitably are connected through suction/pressure lines to an operating unit performing a suction/blowing action via valves which are operable by means of a control device and the opening/closing states of which determine the degree of filling/evacuation of the respective cells depending on the actuation of the control device.

The operating unit suitably comprises a pressure and a suction chamber communicating with each other via a passage in which there is provided a motor-driven fan, each separate air cell space being connected to both the suction and the pressure side of the operating unit through separate valves for each side. This arrangement, in combination with relatively large-size communication lines, makes it possible to efficiently and rapidly control the state of expansion of the different cells.

Suitably, the auxiliary device further comprises a cushion-like lifting cell which is disposed at the head end of the mattress, preferably underneath the head end, and which, like the other cells, can be filled and evacuated for lifting and lowering the head end of the mattress when the patient resting thereon wishes to change from lying to sitting position. In this manner, the patient can easily change the position of his body between lying and sitting position without the assistance of attending personnel, also when in an almost completely paralysed state.

Suitably, the lifting cell is doubled over to form a V-shaped vertical section extending in the longitudinal direction of the mattress, the two legs of the V being formed of air cell portions communicating with each other at the apex of the V, and the open end of the V being located at the head end of the mattress. In this manner, there is achieved a unit performing the largest lifting movement closest to the head end of the mattress, the lifting movement decreasing in a direction away therefrom, resulting in a pressure distribution, which is gentle on the patient, along the underside of the mattress An embodiment of the auxiliary device according to the invention will be described hereinafter with reference to the accompanying drawings, in which:

Figure 12:
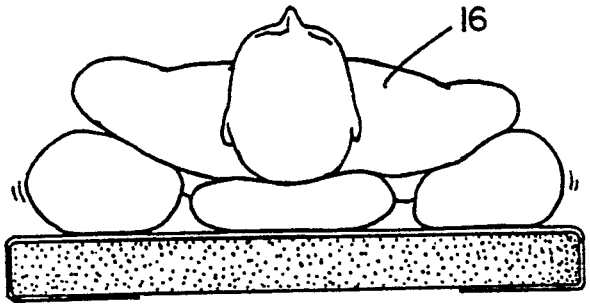
Figure 13:
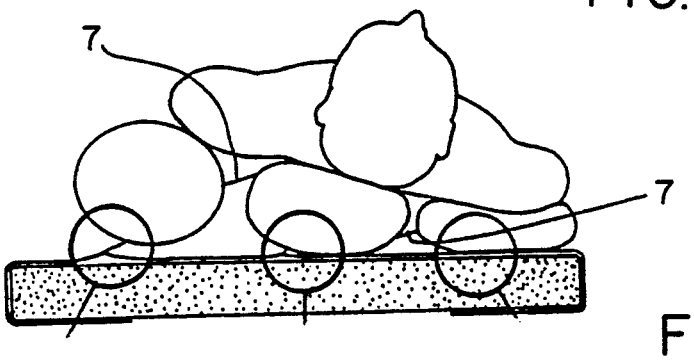
Figure 13A:
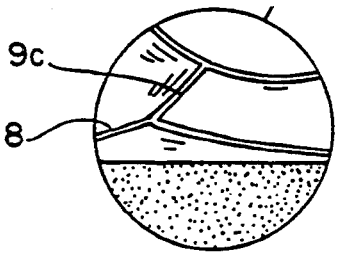
Figure 13B:
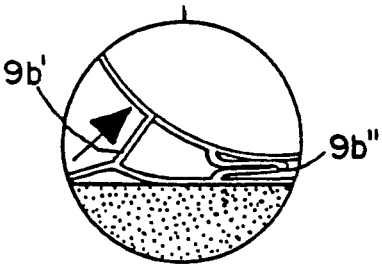
Figure 13C:
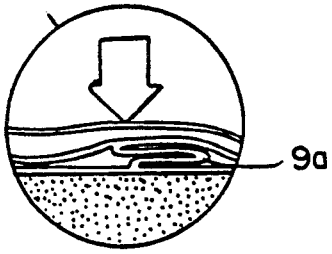
Figure 14:
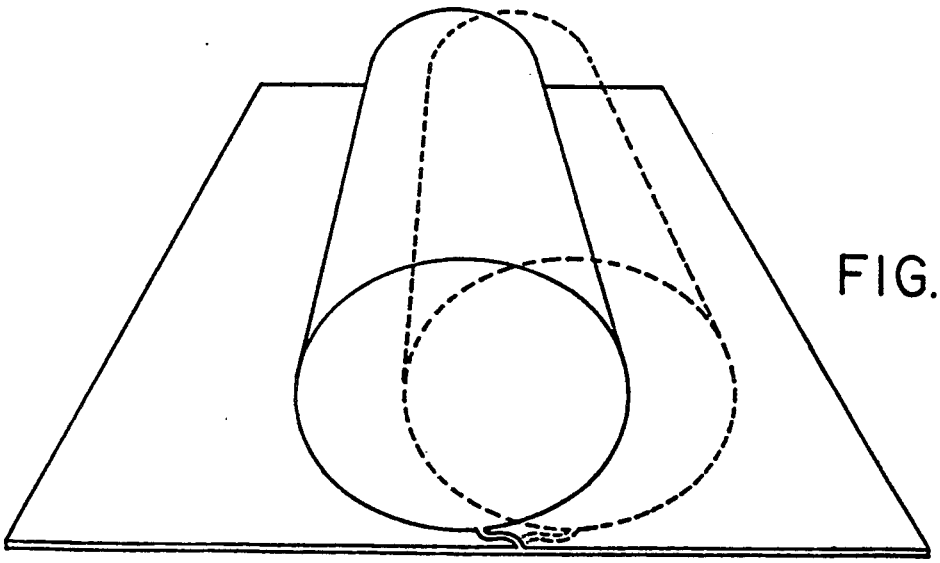

FIG. 12 schematically shows the mattress in cross-section with a patient lying thereon in supine position;

FIG. 13 shows the same mattress with the patient in a slightly laterally tilted supine position;

FIGS. 13A–13C show the connecting portions between the respective cell and the mattress bottom; and FIG. 14 is a schematic perspective view showing the lateral movement of one of the outer cells of the mattress.

Figure 1:
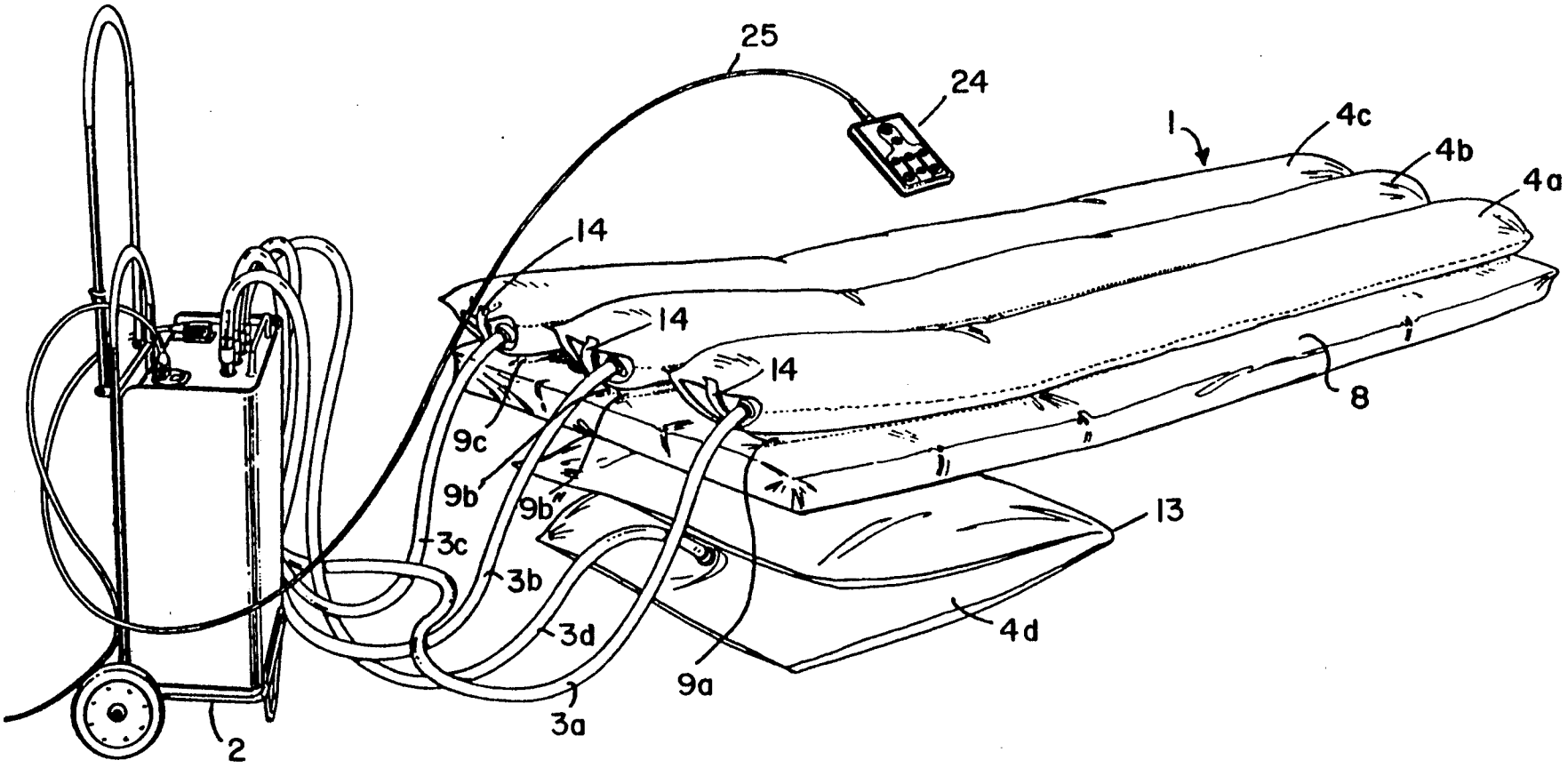
FIG. 1 is a perspective view of the auxiliary device according to the invention with an operating system associated therewith.
Figure 6:
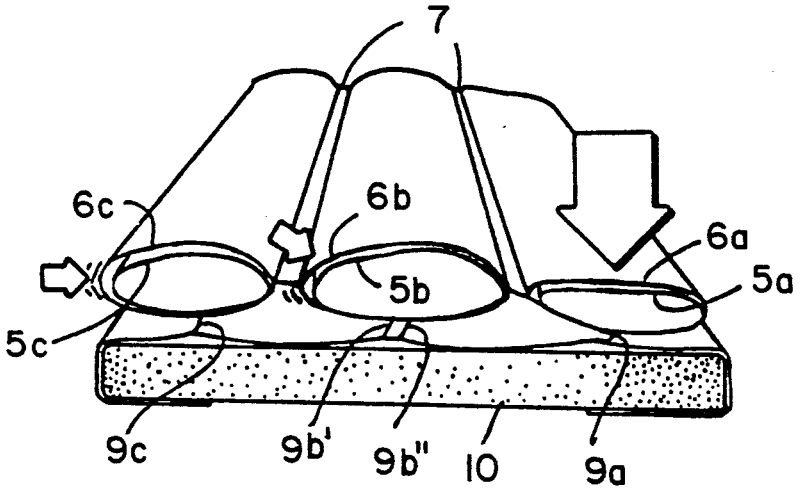
FIGS. 6 and 7 are cross-sectional views schematically showing the mattress with the central cell and the two juxtaposed cells in different states of expansion.
Figure 7:
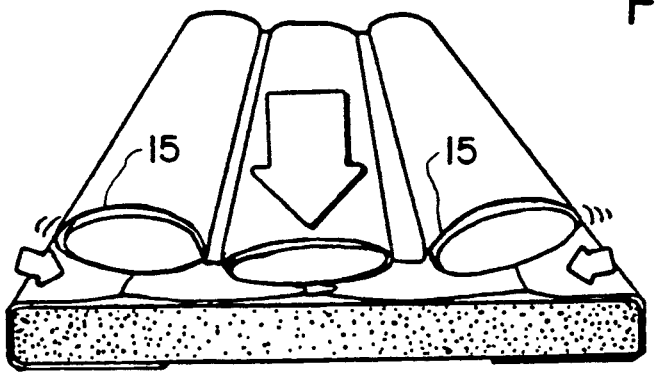
Figure 8:
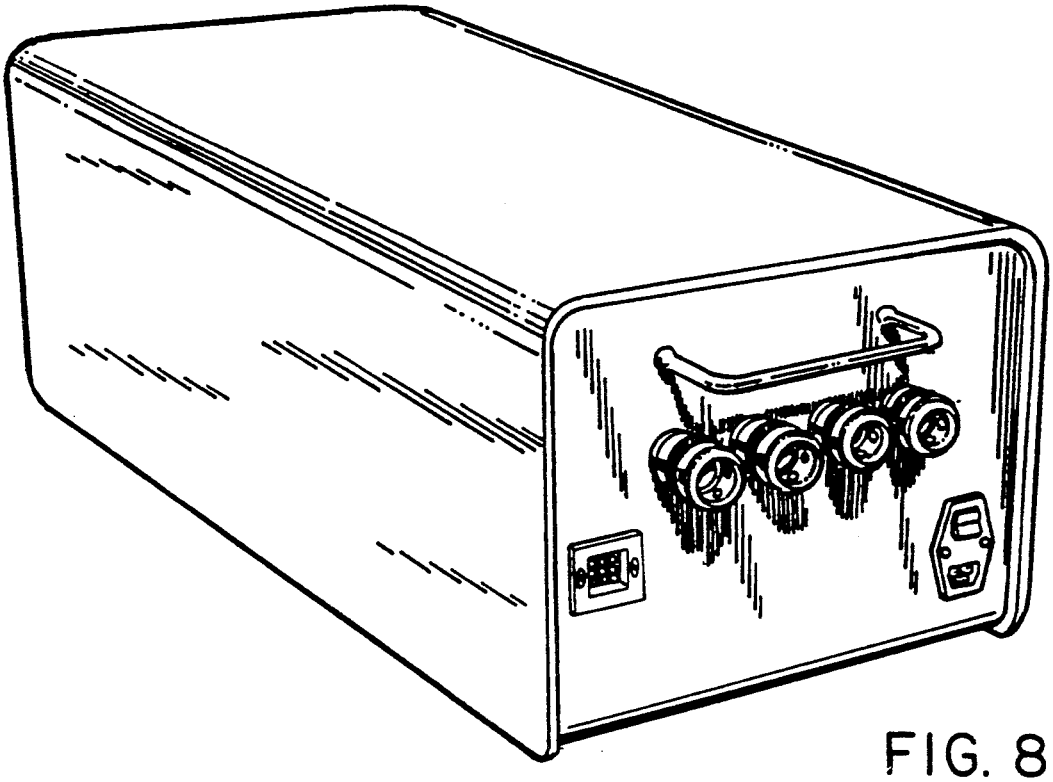
FIGS. 8 and 9 are two diametrically opposed perspective views of the main part of the operating unit by means of which the state of expansion of the cells is controlled.
Figure 9:
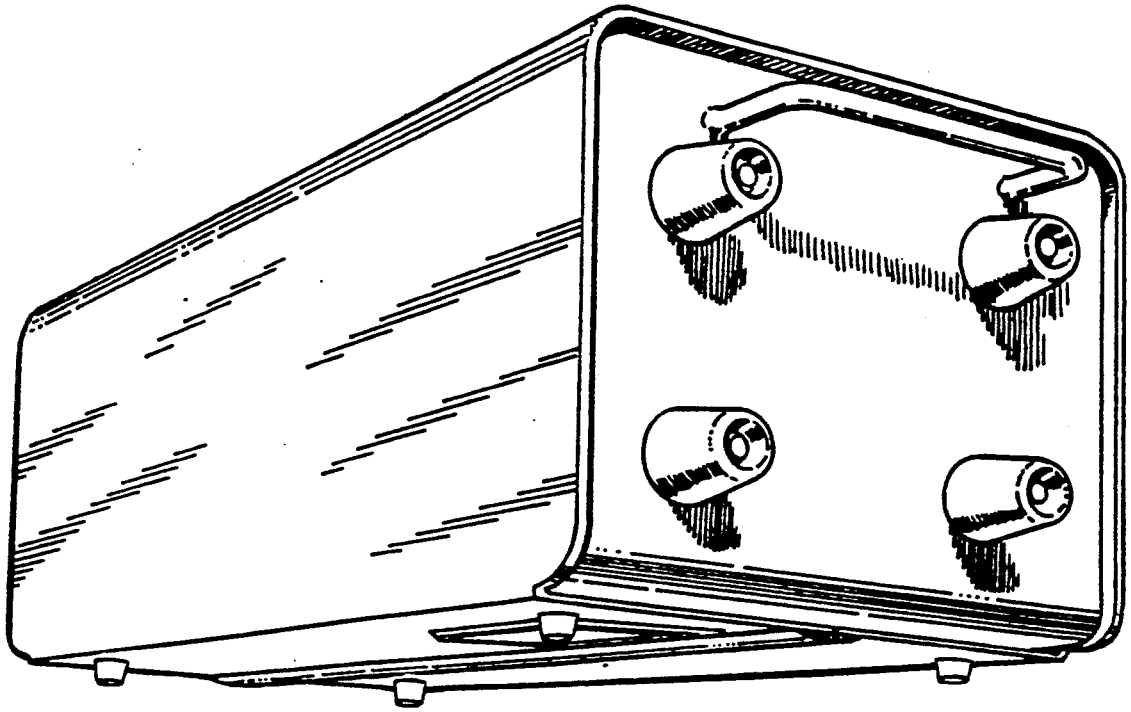
Figure 10:
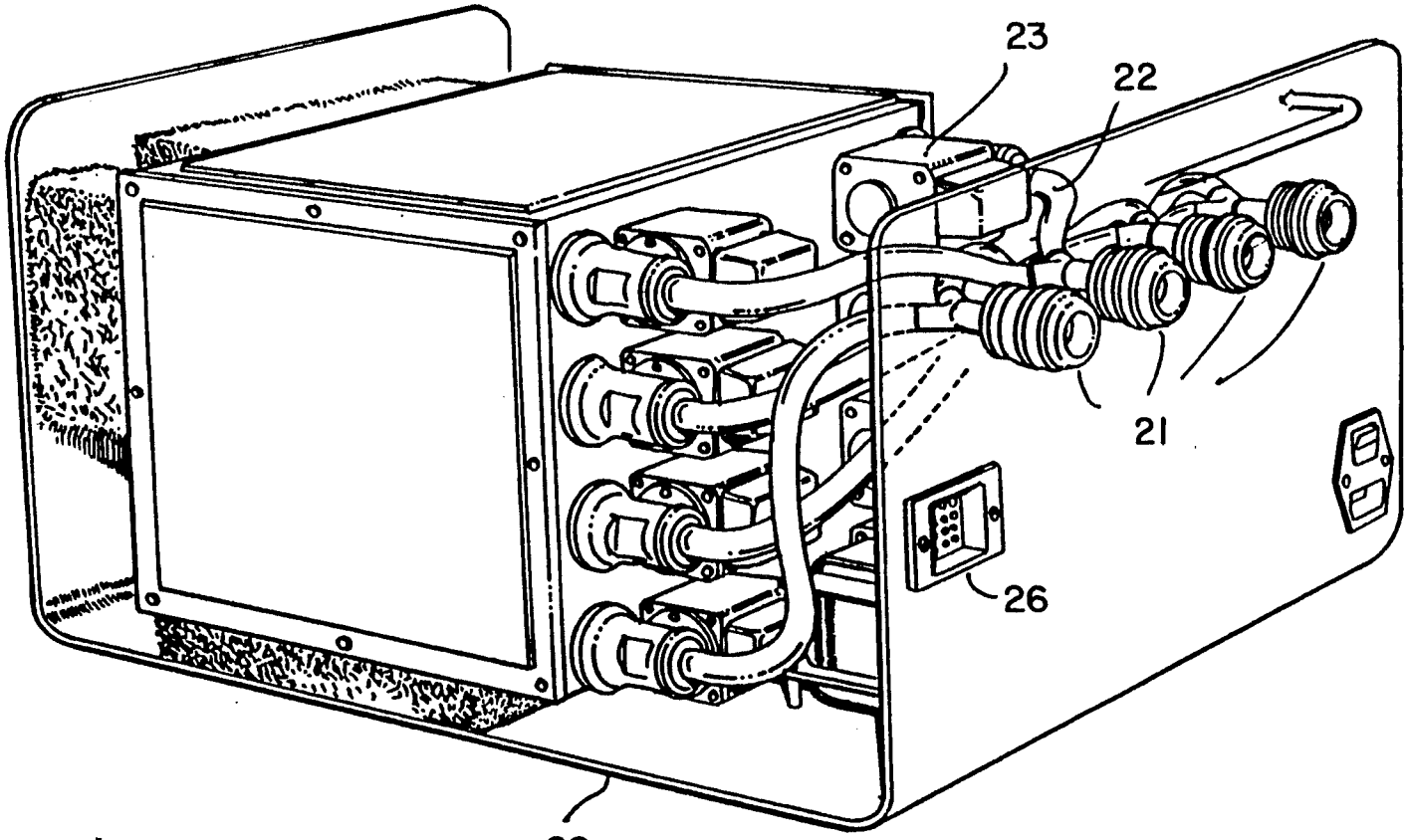
FIG. 10 shows the same operating unit with the outer casing removed.

In FIG. 1, reference numeral 1 designates the part of the device which serves as mattress while 2 designates an operating unit which via a number of lines 3*a*, 3*b*, 3*c* and 3*d* communicates with respective cells 4*a*, 4*b*, 4*c* and 4*d* included in the mattress. The operating unit 2 is used for establishing the desired degree of expansion of the cells 4. The operating unit will be described in more detail later on. In the illustrated embodiment, the mattress has three cells. Although this number has been found especially suitable, the mattress may of course have a larger number of cells without departing from the scope of the invention. The cells consist of an inner tube-like, inflatable and deflatable, airtight means 5*a*–5*c* inserted in an outer cover 6*a*–6*c* suitably of cloth material. The covers 6*a*–6*c* are connected to each other by means of strip-shaped cloth portions 7 bridging the gap between the covers. Also, the covers 6*a*–6*c* are connected to a mattress bottom 8 of cloth material via likewise strip-shaped cloth portions 9*a*, 9*b*′, 9*b*″ and 9*c*. In the drawings, the mattress bottom 8 is folded over the edges of a mattress-like slab 10 which optionally may rest on a rigid backing plate 11, 12, as shown in FIG. 3. The air cell 4*d* which is diposed underneath the head end portion of the mattress is folded to form a V, as best seen in FIGS. 1 and 3, the legs of the V expanding in a direction from the apex 13 of the V towards the head end of the mattress, which means that the largest lifting movement, upon expansion of the cell 4*d*, is obtained closest to this end of the mattress. To prevent the tubes 5*a*–5*c* from moving out of the covers 4*a*–4*c*, the inlet end of the covers is closed by means of closure strips 14. As best seen in FIGS. 6 and 7, but also seen in FIGS. 1–4, the outer cells are connected to the mattress bottom by means of a piece of cloth 9*a*, 9*c* centrally disposed underneath these cells, whereas the central cell is connected to the mattress bottom by means of two pieces of cloth 9*b*′ and 9*b*″ which are arranged in spaced apart relationship close to the middle of the central cell. Between the outer sides of the cells and the strips of cloth connecting the cells to each other and to the mattress bottom, there are defined spaces in the form of channels 15 which suitably can be used for the introduction of air or subjected to evacuation for cooling, ventilating and/or drying the parts of the patient resting on the mattress, by the strips of cloth 7 which interconnect the cells and which suitably consist of air-permeable woven fabric.

In FIG. 6, the blank arrows indicate the movement of the upper part of the mattress when one of the lateral cells is evacuated while maintaining the pressure in the other two. Similarly, FIG. 7 illustrates by blank arrows the movement of the different parts of the mattress when the central cell is evacuated while the lateral cells are maintained in the expanded state. These lateral movements are efficiently brought about by means of the strips of cloth 9 connecting the cells to the mattress bottom.

Figure 2:
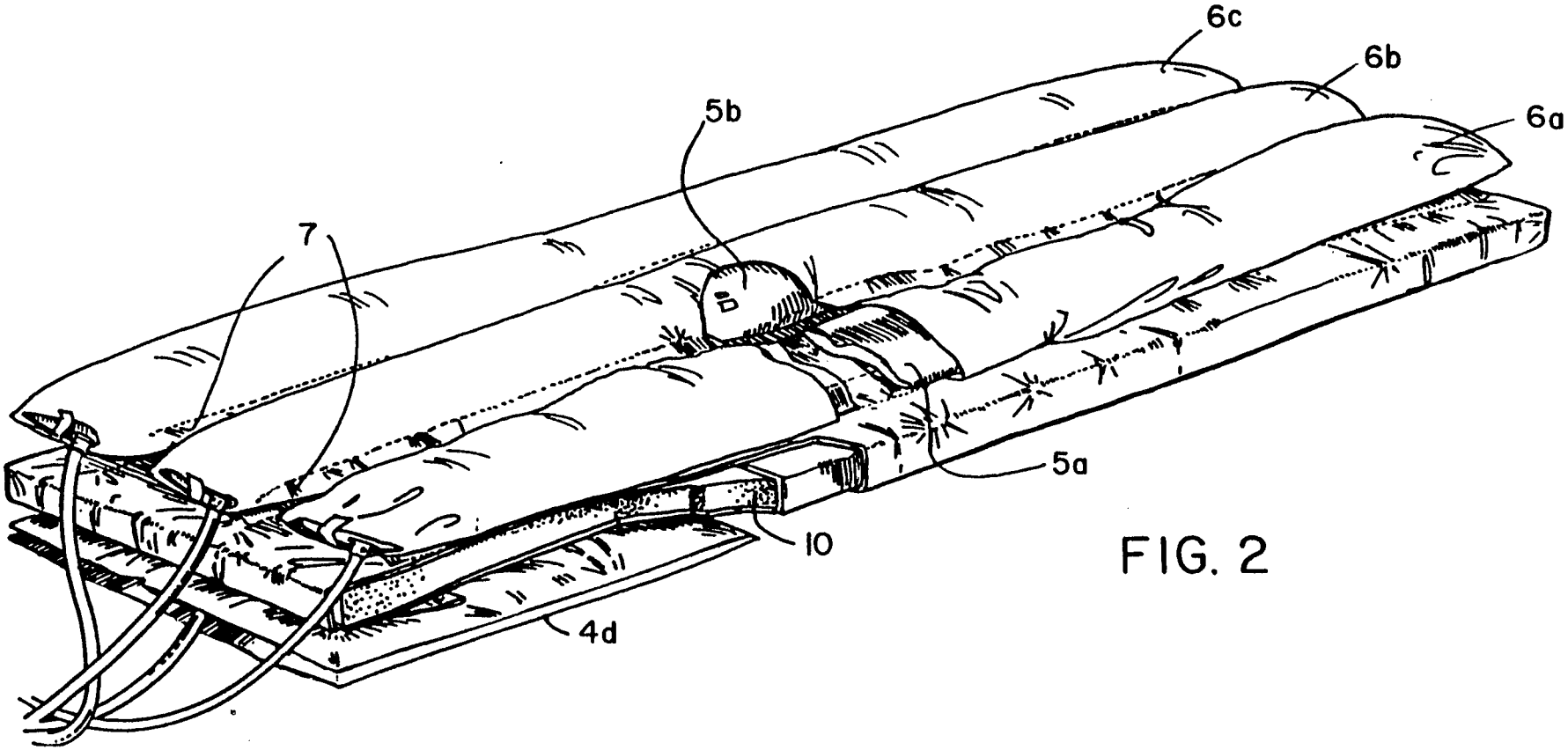
FIG. 2 is a corresponding perspective view of the mattress itself with certain portions removed to illustrate its interior design, the mattress being in a planar state.
Figure 3:
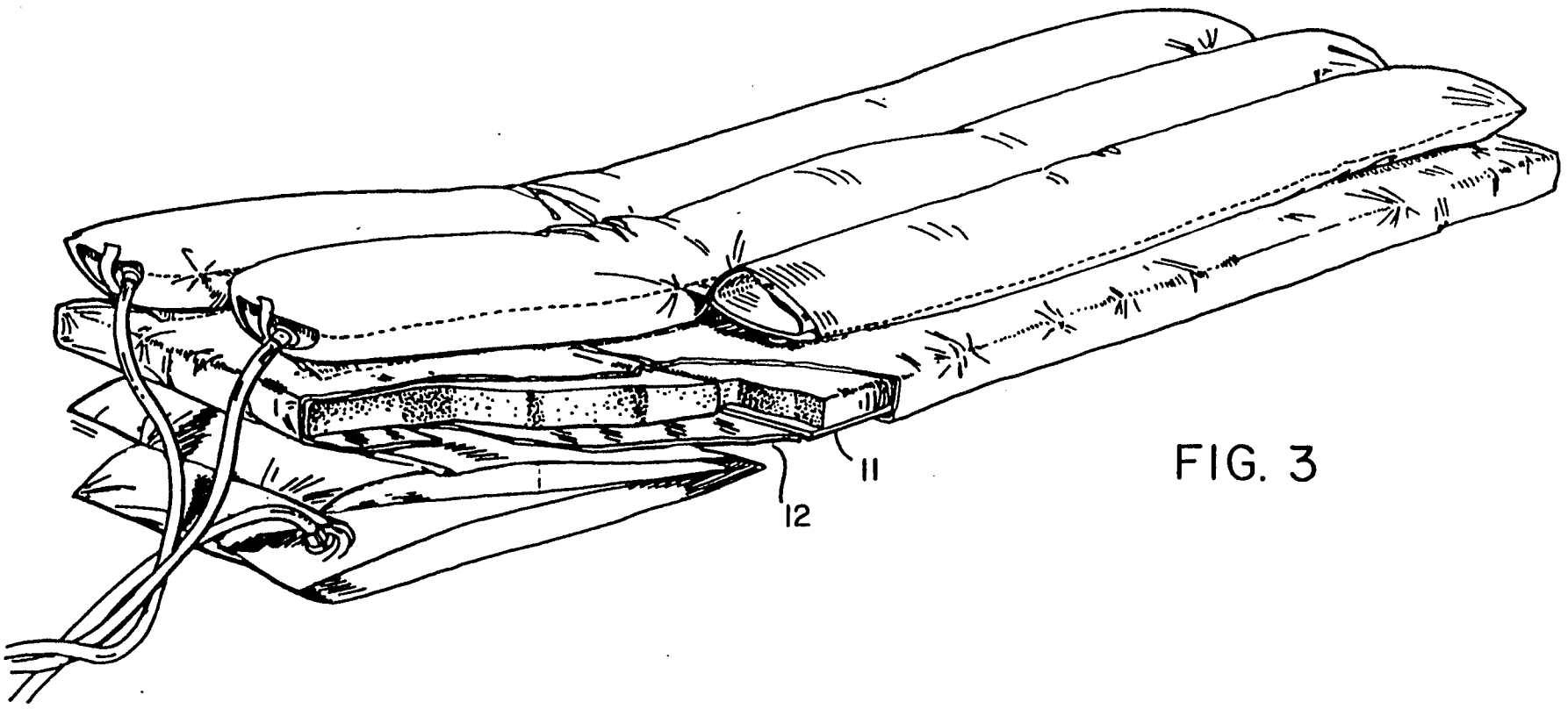
FIG. 3 is a corresponding perspective view of the same mattress with certain portions removed to illustrate its design and with the head end portion partly raised.
Figure 4:
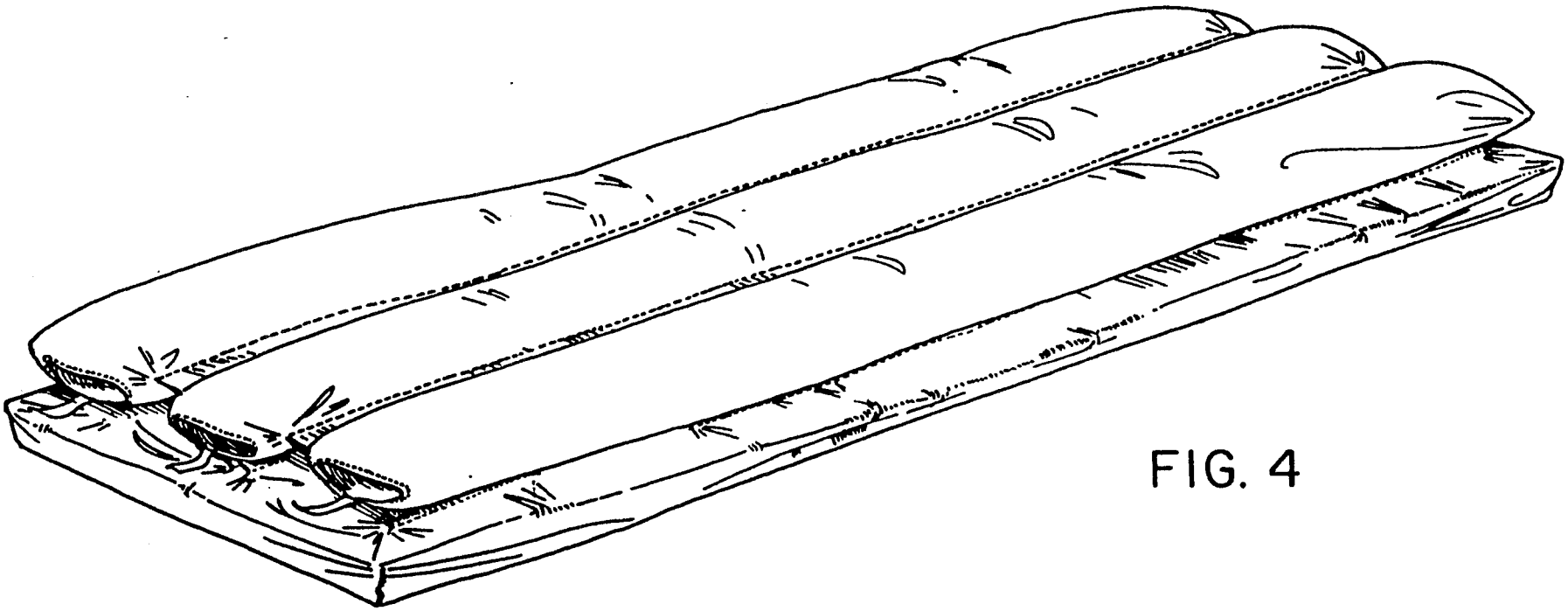
FIGS. 4 and 5 show the air cell part with the surrounding cloth in two diametrically opposed views.
Figure 5:
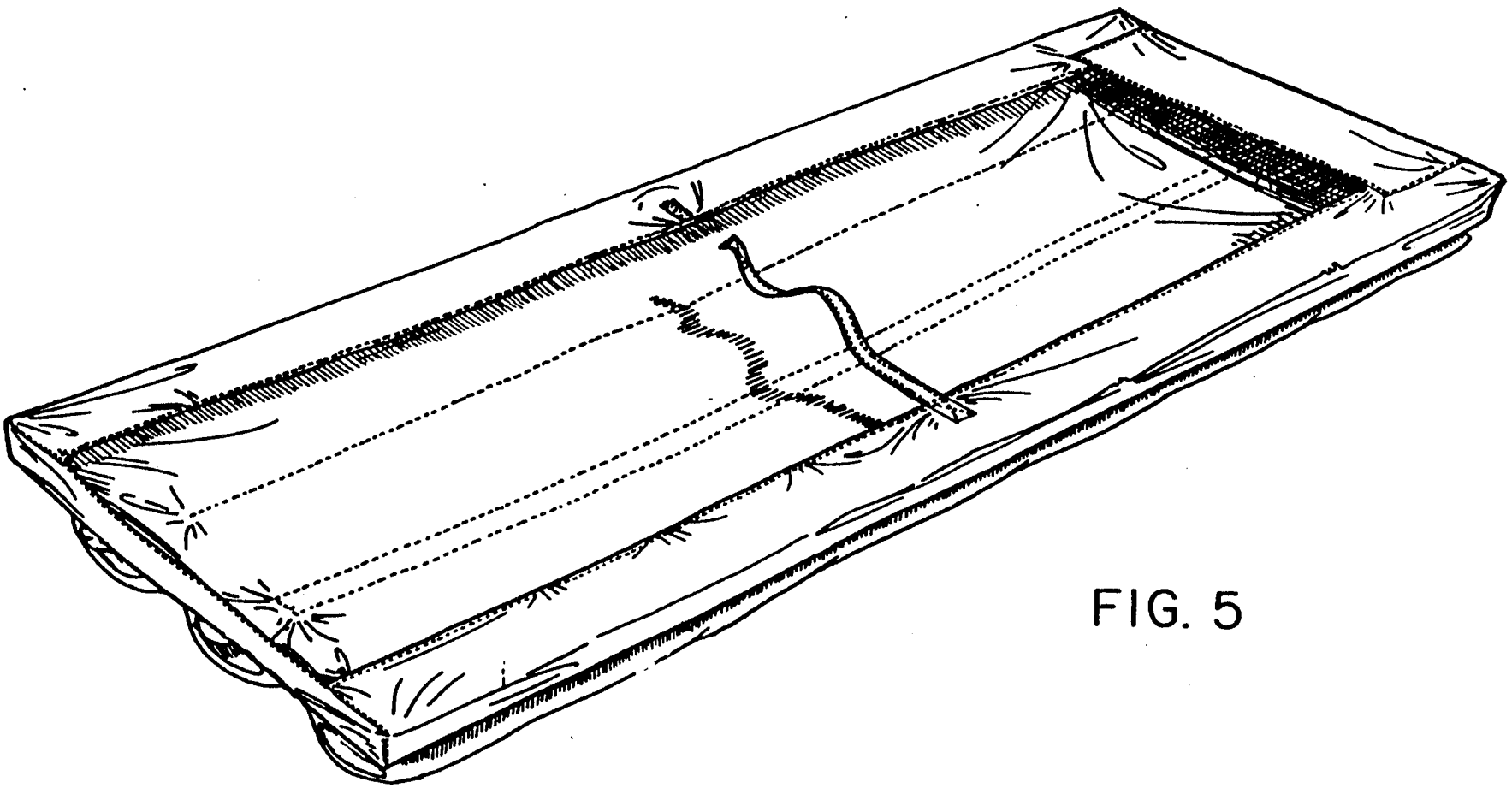

FIG. 12 corresponds to FIG. 2 with the exception that a patient 16 is lying on the mattress. FIG. 12 thus shows the patient in a symmetrical supine position. Similarly, FIG. 13 corresponding to FIG. 6 shows a patient resting on the mattress in a slightly laterally tilted supine position. FIG. 13*a* illustrates the connection to the mattress bottom of the cell located to the left in FIG. 13, FIG. 13B illustrates the corresponding connection to the mattress bottom of the central cell, and FIG. 13C illustrates the connection to the mattress bottom of the cell located to the right. In FIG. 13, the central cell has been slightly turned clockwise by the movement of the patient, which means that the connecting strip of cloth 7 located to the left of the central cell has pulled the left-hand cell to the right while the right-hand cell has participated in this movement. This means that the patient 16, despite the rotary movement, still is adequately supported by all the cells which thus adjust to the movements of the body in a gentle manner.

Figure 11:
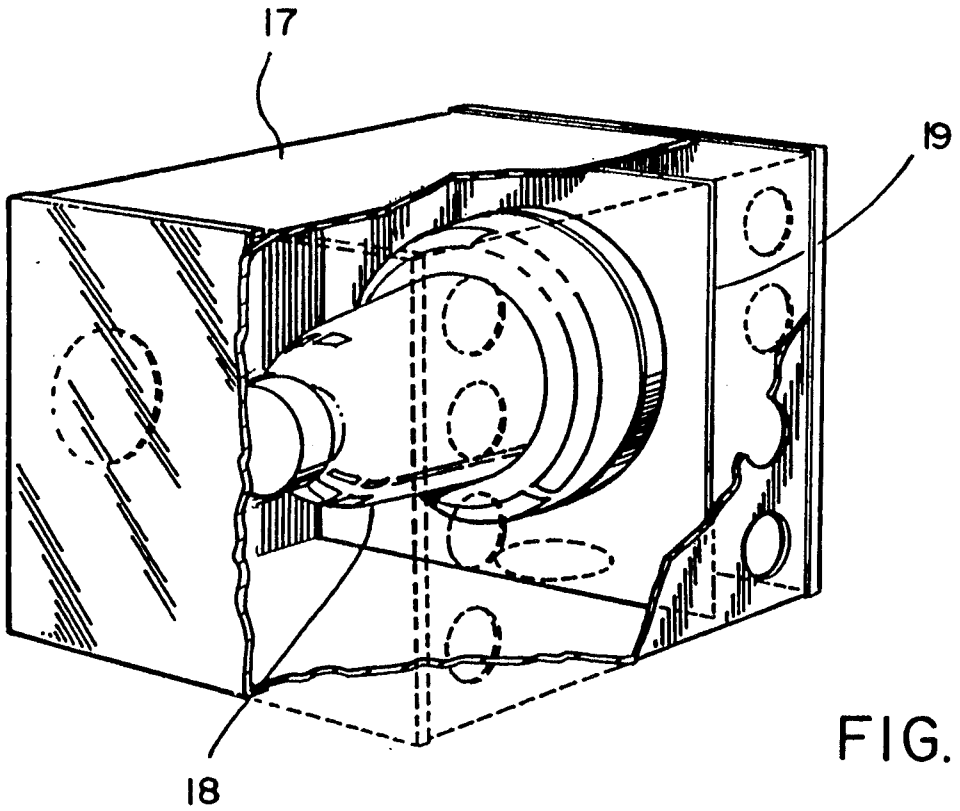
FIG. 11 is a view with certain parts broken away, schematically showing the interior of the operating unit of FIG. 10.

The operating unit 2 used for adjusting the degree of expansion of the cells comprises, as best seen in FIG. 11, a box-shaped housing 17 accommodating a motor-driven fan 18 mounted in a partition 19 so as to define in the housing 17 an evacuation space on one side of the partition 19 and a pressure space on the other side of the partition 19. Via connecting nipples 21 provided in the outer casing 20 of the operating unit, each of the lines 3 leading to the cells of the mattress can be connected through branch lines 22 and shut-off valves 23 to both the evacuation and the pressure space or to either of these spaces, depending on the position of the different shut-off valves 23. The position of the shut-off valves 23 is determined from a control device 24 suitably situated within easy reach of the patient resting on the mattress. The keyset of the device 24 or like device for controlling the valves may within the scope of the invention be arranged in any suitable manner adapted to the particular handicap of the patient concerned. The control device 24 is connected to the operating unit 2 via a connecting cable 25 to be connected to a socket 26 on the operating unit. The valves 23 suitably are solenoid valves which are electronically controlled from the control device 24. The use of any other type of valve equipment controlled otherwise than electronically however falls within the scope of the invention. The control of the valves may be dependent on the type of handicap of the patient. For instance, it may be suitable in some cases to provide air-controlled valves which the user can operate e.g. by blowing air into different mouthpieces, thus replacing the control device 24. Suitably, the lines 3 have relatively large dimensions, making it possible to rapidly modify the degree of filling of the cells also in case of relatively small pressure differences. By opening and closing suitable valves, it is possible to evacuate one cell while filling another. Optionally, all cells can be operated at the same time. When one cell is emptied while another is being filled, air is passed via the operating unit 2 from one cell to the other. In the case of filling only, air is drawn from the surrounding atmosphere, and in the case of evacuation only, air is discharged into the atmosphere. To this end, the operating unit is provided with suitable means for connecting the interior thereof to the atmosphere.

The foregoing has dealt with an embodiment which is not intended to restrict the invention but merely meant to exemplify the application thereof. Thus, the invention can be modified as to its details within the scope of the accompanying claims without departing from the basic concept of the invention. Thus, the use of a number of cells different from the three cells shown in the drawings falls within the scope of the invention. Using single wall cells and directly connecting their airtight walls to each other and to the mattress bottom also falls within the scope of the invention. This arrangement is applicable in the absence of covers. The mattress can be placed in any desired place, both on a planar surface, such as a floor, and in a bed. The use of the device can be varied in many different ways according to the need of the patient. Although it probably is preferable to use valves 23 that are individually operable, it may be suitable in some cases to arrange them with a certain mutual dependence as regards their opening and closing movements. Optionally, it may be suitable to control the valves arranged in one and the same branch line, in such a manner that when the fan is in operation they are not open simultaneously when the associated cell is being inflated.

I claim:

1. Auxiliary device serving as mattress, primarily for physically handicapped persons, the active part of the device, i.e. the part which in use forms the surface on which the patient (16) is lying, consisting of a number of individually and freely selectably fillable and evacuable, flexible cell bodies (4) principally extending in the longitudinal direction of the mattress (1) and fixed to a mattress bottom (8), said cell bodies being adapted, by their upper side, to support the patient (16) and to permit varying the position of the patient lying on the mattress by changing the state of expansion of adjacent cell bodies, characterised in that the cell bodies are laterally connected to each other by means of flexible cloth material (7) bridging the gap between the cell bodies, and further connected to said mattress bottom (8) by means of likewise flexible cloth material (9), whereby the cell bodies are laterally movable in relation to their place of fixation in the mattress bottom and a maximum distance between juxtaposed cell bodies is ensured as well as a certain mutual adaptability of adjacent cell bodies during lateral movement.

2. Auxiliary device as claimed in claim 1, characterised in that the cloth (9) connecting the cell bodies to the mattress bottom is fixed to the underside of the cell bodies adjacent the center thereof.

3. Auxiliary device as claimed in claim 2, characterized in that the outer sides of the cells, the cloth interconnecting the cells and the mattress bottom define air-receiving spaces, the cloth connecting the cells to each other being air-permeable to permit passage of air to and from parts of the body of the patient lying on the mattress.

4. Auxiliary device as claimed in claim 2, characterized in that the air cells are surrounded by cloth material passing into portions connecting the cells to each other and to the mattress bottom.

5. Auxiliary device as claimed in claim 2, characterized in that each cell is connected through suction/pressure lines t an operating unit performing a suction/-blowing action via valves which are operable by means of a control device and the opening/closing states of which determine the degree of filling/evacuation of the respective cells depending on the actuation of the control device.

6. Auxiliary device as claimed in claim 2, characterized in that it has an uneven number, of cell bodies, at least the central cell of the device having at least two pieces of cloth (**9*b*', 9*b*") spaced from each other in the transverse direction of the cell and connecting it to the mattress bottom (8**).

7. Auxiliary device as claimed in claim 6, characterized int hat the outer sides of the cells, the cloth interconnecting the cells and the mattress bottom define air-receiving spaces, the cloth connecting the cells to each other being air-permeable to permit passage of air to and from parts of the body of the patient lying on the mattress.

8. Auxiliary device as claimed in claim 6, characterized in that the air cells are surrounded by cloth material passing into portions connecting the cells to each other and to the mattress bottom.

9. Auxiliary device as claimed in claim 6, characterized in that each cell is connected through suction/pressure lines to an operating unit performing a suction/-blowing action via valves which are operable by means of a control device and the opening/closing states of which determine the degree of filling/evacuation of the respective cells depending on the actuation of the control device.

10. Auxiliary device as claimed in claim 1, characterised in that the outer sides of the cells, the cloth (7) interconnecting the cells and the mattress bottom (8) define air-receiving spaces (15), the cloth (7) connecting the cells to each other being air-permeable to permit passage of air to and from parts of the body of the patient (16) lying on the mattress.

11. Auxiliary device as claimed in claim 10, characterized in that the air cells are surrounded by cloth material passing into portions connecting the cells to each other and to the mattress bottom.

12. Auxiliary device as claimed in claim 10, characterized in that each cell is connected through suction/-pressure lines to an operating unit performing a suction/blowing action via valves which are operable by means of a control device and the opening/closing states of which determine the degree of filling/evacuation of the respective cells depending on the actuation of the control device.

13. Auxiliary device as claimed in claim 1, characterised in that the air cells are surrounded by cloth material (6) passing into portions (7; 9) connecting the cells to each other and to the mattress bottom.

14. Auxiliary device as claimed in claim 13, characterized in that each cell is connected through suction/-pressure lines to an operating unit performing a suction/blowing action via valves which are operable by means of a control device and the opening/closing states of which determine the degree of filling/evacuation of the respective cells depending on the actuation of the control device.

15. Auxiliary device as claimed in claim 13, characterized in that the mattress bottom (8) is also formed of cloth material foldable about a mattress-like support structure (10).

16. Auxiliary device as claimed in claim 15, characterized in that each cell is connected through suction/-pressure lines to an operating unit performing a suction/blowing action via valves which are operable by means of a control device and the opening/closing states of which determine the degree of filling/evacuation o the respective cells depending on the actuation of the control device.

17. Auxiliary device as claimed in claim 1, characterised in that each cell (4) is connected through suction/-pressure lines (3) to an operating unit (2) performing a suction/blowing action via valves (23) which are operable by means of a control device (24) and the opening/-closing states of which determine the degree of filling-/evacuation of the respective cells depending on the actuation of the control device.

18. Auxiliary device as claim din claim 17, characterised in that the operating unit (2) comprises a pressure and a suction chamber communicating with each other via a passage in which there is provided a motor-driven fan (18), each separate air cell space being connected to both the suction and the pressure side of the operating unit through separate valves (23) for each side.

19. Auxiliary device as claimed in claim 1, characterised in that it comprises a cushion-like lifting cell (**4*d*) which is disposed at the head end of the mattress, preferably underneath the head end, and which, like the other cells, can be filled and evacuated for lifting and lowering the head end of the mattress when the patient (16**) resting thereon wishes to change from lying to sitting position.

20. Auxiliary device as claimed in claim 19, characterised in that the lifting cell (**4*d***) is doubled over to form a V-shaped vertical section extending in the longitudinal direction of the mattress, the two legs of the V being formed of air cell portions communicating with each other at the apex of the V, and the open end of the V being located at the head end of the mattress.

* * * * *